United States Patent [19]

Hay et al.

[11] 4,003,429

[45] Jan. 18, 1977

[54] APPARATUS FOR LOADING GAS-CONVEYED PARTICULATE SOLIDS INTO A BOREHOLE

[75] Inventors: David Gilbert Hay, Balaclava; Richard Fox, Rosanna, both of Australia

[73] Assignee: ICI Australia Limited, Australia

[22] Filed: June 12, 1975

[21] Appl. No.: 586,341

Related U.S. Application Data

[63] Continuation of Ser. No. 383,551, July 30, 1973, abandoned.

[30] Foreign Application Priority Data

Aug. 17, 1972 Australia ..... 127/72

[52] U.S. Cl. ..... 166/51; 166/229; 86/20 C

[51] Int. Cl.[2] ..... E02D 7/24; E21B 43/08

[58] Field of Search ..... 86/20 C, 27; 102/22; 166/227, 228, 229, 230, 51; 61/35

[56] References Cited

UNITED STATES PATENTS

| | | | |
|---|---|---|---|
| 615,847 | 12/1898 | Hansen | 166/227 UX |
| 3,170,366 | 2/1965 | Alfredsson | 86/20 C |
| 3,541,797 | 11/1970 | Stewart | 86/20 C X |

*Primary Examiner*—Stephen J. Novosad
*Attorney, Agent, or Firm*—Cushman, Darby & Cushman

[57] ABSTRACT

A device for facilitating the placement of particulate solids into voids. In particular, the device allows boreholes to be filled with a particulate solid material with a reduction in the amount of turbulence thereby allowing the achieving of the proper density for the particulate material. The device includes an improved mantle mounted adjacent the outlet end of the particulate material supply tube for separating the particulate solid material from liquids and gases. The mantle has a perforated portion in contact with the supply tube and a solid portion in contact with the borehole.

4 Claims, 3 Drawing Figures

APPARATUS FOR LOADING GAS-CONVEYED PARTICULATE SOLIDS INTO A BOREHOLE

This is a continuation of application Ser. No. 383,551 filed July 30, 1973, now abandoned.

This invention relates to an apparatus to facilitate the placement of particulate solids in voids, in particular the placement of particulate solid explosives in boreholes.

In the mining industry, for instance, rock is broken away by drilling boreholes which are subsequently filled with explosives and detonated. Frequently such explosives are in the form of particulate solids, for example ANFO which is a composition of ammonium nitrate prills with absorbed fuel oil. Such particulate solid explosives may be placed in the holes by pouring the particles into the holes, if they are inclined substantially below the horizontal. In holes included above the horizontal and sometimes in down-holes the particles are conveyed into the holes pneumatically.

It is important to pack the explosive into the hole as densely as possible. This is an advantage of pneumatic loading as this compacts the particles in the hole provided the hole is dry. If the hole contains water, as can frequently happen in down-holes, the turbulence caused by pneumatic loading can cause substantial amounts of water soluble explosives to be dissolved during loading.

We have now found that by conveying into a void particulate solids suspended in a gas medium through an apparatus, as hereinafter described, this undesired turbulence is reduced in the area adjacent to the end of the loading hose.

Accordingly we provide a device for loading gas conveyed particulate solid into a void at least partially filled with liquid which device comprises a tube for conveying said solids, the discharge end of the tube is surrounded by a coaxial perforated mantle attached to the tube and capable of forming a seal with the sides of the void and the perforations are of a size small enough to cause the gas to form small bubbles and large enough to prevent fines from the particulate solid from blocking the perforations.

Suitable sizes of perforations may be found by simple experiment. In general the dustier the particulate solid the coarser the perforations need to be to prevent blocking. The mantle causes a build-up of pressure in the space beneath the mantle and the amount of pressure build-up may be adjusted by the size and number of perforations in the mantle. In general the higher the loading pressure the larger the proportion of perforation will be required to prevent the loading hose from being blown back up the borehole. However, sufficient build-up of pressure is required to prevent liquid passing back through the perforations. Preferably the perforations are in the form of a wire gauze inserted into the upper portion of the mantle.

We have found that using standard ANFO composition and using standard loading means that suitable gauze is in the mesh range from 300 to 3000 mesh per sq. in., preferably 400 to 700 mesh per sq. in.

The advantage of this arrangement is that water in the void is effectively expelled through the perforations and thus water soluble solids may be successfully packed into wet voids.

In a preferred aspect of our invention the mantle is attached to the tube at a point spaced from the end of the tube and the outer edge of the mantle extends past the end of the tube.

Our invention will now be further described with reference to particular embodiments of the invention described in FIGS. 1 – 3 wherein.

Figure 1:
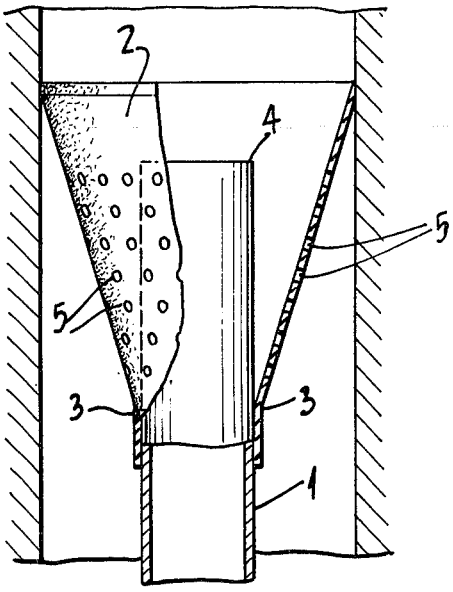
FIG. 1 is a cross-sectioned view of a simple device according to our invention in place in a void, for example in a borehole.

In FIG. 1 the tube, 1, may be a separate section of tubing, preferably circular in cross-section or it may be an integral part of the loading hose through which the particles are conveyed in the gas medium from a storage device into the borehole. If the tube, 1, is separate from the loading tube then it is attached to the latter by a suitable connection not shown in the drawing.

Preferably the tube 1, is constricted at the discharge end so that the velocity of the particles conveyed down the tube is increased and hence the density of the column packing increased.

The mantle, 2, which is attached to the tube, 1, at the points, 3, is in the form of a truncated cone which if it were envisaged as being folded on the tube 1, would project beyond the end, 4, of the tube 1, which end, 4, is the end from whence the particles, conveyed in the fluid, are discharged.

The perforations, 5, in the mantle, 2, are confined to that portion of the mantle which is adjacent to tube 1.

Figure 2:
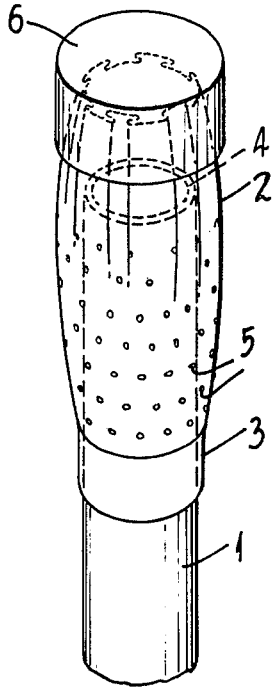
FIG. 2 is a general view of the device ready for insertion in a borehole.

The mantle, 2, is constructed of a material which is sufficiently flexible so that it may be folded onto tube 1 (see FIG. 2) and a cap, 6, may be placed over the end of the mantle, 2, to keep it in this folded condition. It is folded in this form for insertion into the hole. When the particles are conveyed through the tube the cap is pushed off and the mantle assumes the truncated cone shape with the edge not attached to tube 1 making contact with the wall of the hole. The material of construction of the mantle must also be rigid enough to resist any tendency for it to become inverted.

The mantle may comprise one or more materials and it may be of any shape provided it is capable of performing the necessary functions. For example, in a preferred embodiment shown in FIG. 3, which is a cross-sectional drawing the mantle comprises two sections, a cylindrical section 7, attached to the tube 1 at joint 8. This cylindrical section comprises a wire gauze. It is attached by a joint, 9, to a rubber skirt, 10, which is a truncated cone of rubber sheet, 2 mm thick.

Figure 3:
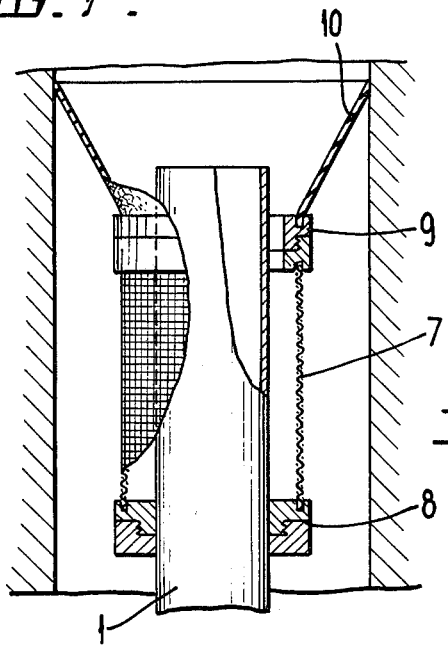
FIG. 3 is a cross-sectioned view of a further device according to our invention.

In use, the apparatus of this invention, with reference to the preferred embodiment in FIG. 3, is inserted into the hole with the skirt folded into a cardboard cap, not shown in FIG. 3. The tube 1, is connected to a loading hose, not shown in FIG. 3, through which ANFO is pneumatically conveyed once the end of the hose is inserted to the end, or toe, of the hole. The pneumatic pressure pushes off the cardboard cap allowing the skirt to assume the dimensions of the hole. The ANFO particles are pneumatically conveyed to the end of the tube from whence they are projected into the end of the hole where a compacted layer will build up; the gas used to pneumatically convey the ANFO is permitted to escape through the gauze 7. As the depth of ANFO increases so the force of discharge of the ANFO will tend to force the loading hose and cone attachment out of the hole.

It will be appreciated that the apparatus of this invention is useful in the filling of holes of various diameter but in particular it is useful for holes in the range 1 inch to 4 inches. The construction of the mantle is such that the same apparatus can be used in holes of varying diameters. Obviously the tube must be of such dimensions that it can be inserted in a hole, generally it is of similar dimensions to the loading hose.

The apparatus of this invention provides a means of reducing "blow-back" and of reducing the turbulence at the surface of the solid being loaded into the hole. This latter is a particular advantage in water filled holes.

Application of the apparatus of this invention is found particularly in loading dry explosives or blasting agents into boreholes but it may also be found in a variety of other applications.

The use of devices according to our invention is illustrated by but by no means limited to the following examples:

EXAMPLE 1

A glass cylinder of internal diameter 3 inches, of length 20 inches and having marked capacity graduations was sealed at one end to simulate an underground borehole. A dry blasting agent, ANFO, comprising particulate ammonium nitrate in the form of spherical prills of approximate diameter 2 mm and having fuel oil adsorbed onto the surface of the prills, was separately loaded into this cylinder by each of the following procedures.

1. A known weight of ANFO was poured from the top of the cylinder and the volume occupied by the resultant column of ANFO was observed.

2. One end of a flexible hose, of internal diameter ¾ inch and of length 10 ft was placed in the bottom of the cylinder. A known weight of ANFO was propelled through this hose and into the cylinder by means of a "Penberthy Anoloader" (Registered Trade Mark for a portable pneumatic loader) operating at an air pressure of 30 psig. During the loading procedure the hose was withdrawn from the cylinder at the same rate as the rate of build-up of the column of ANFO. On completion of the loading the volume of the resultant column of ANFO was observed. The loading method as outlined in procedure 2 was essentially repeated but in this case a device of this invention as described in FIG. 3 was attached to the discharge end of the loading hose. The dimensions of this device were as follows:

a. tube, (1), internal diameter — ½ inch
b. wire gauze (7), length — 3½ inches
c. skirt, (10), external diameter (at widest point) — 3 inches
d. skirt, (10), external diameter (at narrowest point) — 2 inches
e. wire gauze (7) size — 580 mesh per square inch The weights of solid ANFO occupying a measured volume were determined for each technique. The effective densities were calculated from these measurements and found to be 0.80 g per cubic centimetre in the case of procedure 1 and 0.82 g per cubic centimetre in the case of procedure 2. However, in the case of procedure 3, using the apparatus of this invention, the effective density of ANFO was found to be 0.90 g per cubic centimeter.

It was also found that during the loading operation of procedure 2 considerable "blow-back" of fine particles of ANFO occurred. The apparatus of this invention, used in procedure 3, effectively prevented this occurring.

EXAMPLE 2

The procedures of Example 1 were essentially repeated but in this case the glass cylinder was filled with water prior to each loading procedure, to simulate conditions encountered in wet underground boreholes.

The effective density of soild ANFO was found to be 0.74 g per cubic centimeter in the case of procedure 1 and 0.72 g per cubic centimeter in the case of procedure 2.

In the case of procedure 3, using the apparatus of this invention, the effective density of ANFO was 1.13 g per cubic centimeter.

It was also found that during the loading operation of procedure 2 there was a tendency for some of the blasting agent to be propelled up the sides of the cylinder and away from the column of ANFO by the escaping air/water mixture. The apparatus of this invention, used in procedure 3, effectively prevented this occurring.

EXAMPLE 3

The procedures of Example 1 and Example 2 were repeated using the same apparatus according to the invention except that the mesh size of the wire gauze was altered.

When the wire gauze contained 400 mesh per square inch the results obtained were similar to the results obtained with the apparatus of the invention used in Examples 1 and 2. When the wire gauze contained 3600 mesh per square inch the gauze blocked up and the apparatus was unsatisfactory.

EXAMPLE 4

This example illustrates the filling of a borehole using the apparatus of our invention.

One end of a ¾ inch internal diameter tube was connected to a device as described in FIG. 3 and Example 1 except that the external diameter of the skirt (14) at the widest point was 4 inches. The hose and device were inserted to the bottom of a borehole 20 feet long and containing 8 feet of water. ANFO of the grade used in Example 1 was loaded into the borehole using the 'Penberthy Anoloader'.

The borehole when filled with ANFO fired satisfactorily.

We claim:

1. A device for loading gas conveyed particulate solid into a borehole partially filled with liquid comprising a tube for conveying said solid, mantle means for separating said solid from said liquid and said gas, said mantle means being resistant to inversion and mounted adjacent the discharge end of said tube and coaxially therewith wherein said mantle means further includes perforated and unperforated portions and said mounting is such that said perforated portion is in contact with said tube and said unperforated portion is in contact with said borehole and at least a part of said perforated portion having perforations of a size in a mesh range of from 300 to 3000 mesh per square inch and wherein the uperforated portion of said mantle means comprises a truncated cone and the perforated portion of said mantle means comprises a cylinder having perforations therein wherein the cylinder is secured to the tube adjacent the end thereof and the truncated cone is attached to the cylinder so that said liquid and said gas pass out of the borehole through said cylinder.

2. A device according to claim 1 wherein the size of said perforations is in the mesh range of 400–700 mesh per square inch.

3. A device according to claim 1 wherein said truncated cone is constructed of a rigid material whereby said cone can be compressed inwardly toward said tube and be resistant to being inverted.

4. A device according to claim 3 wherein at least a portion of the walls of said cylinder comprise wire gauze.

* * * * *